United States Patent [19]

Seiwert

[11] 3,973,573

[45] Aug. 10, 1976

[54] SCRAP WASHING SYSTEM

[75] Inventor: Paul J. Seiwert, Cincinnati, Ohio

[73] Assignee: The MacLeod Company, Cincinnati, Ohio

[22] Filed: Oct. 31, 1974

[21] Appl. No.: 519,620

[52] U.S. Cl. ..... 134/63; 134/104

[51] Int. Cl.[2] ..... B08B 3/00

[58] Field of Search ..... 134/63, 65, 104, 111, 134/132; 209/13, 17, 18, 173, 272; 210/167, 297, 298, 312, 320, 401, 526; 137/546, 547

[56] References Cited

UNITED STATES PATENTS

| | | | |
|---|---|---|---|
| 967,008 | 8/1910 | Franz | 209/272 X |
| 2,196,451 | 4/1940 | Holzer | 209/17 |
| 2,572,236 | 10/1951 | Anderson | 210/297 |
| 2,782,929 | 2/1957 | Colket | 210/320 X |
| 3,243,039 | 3/1966 | Harshberger | 209/17 X |
| 3,273,573 | 9/1966 | Southard | 134/104 |
| 3,411,518 | 11/1968 | Fisher et al. | 134/104 |
| 3,456,798 | 7/1969 | Urdanoff | 210/167 X |
| 3,506,022 | 4/1970 | Nolte | 134/104 |
| 3,754,559 | 8/1973 | Seiwert | 134/104 X |

*Primary Examiner*—Peter Feldman
*Assistant Examiner*—Robert Pous
*Attorney, Agent, or Firm*—Melville, Strasser, Foster & Hoffman

[57] ABSTRACT

A scrap washing system wherein scrap metal, such as crushed engine blocks or other oil and grease contaminated metal scrap, is cleaned by a washing operation to remove the oil, grease or other foreign materials prior to the melting of the scrap for reuse, the system including a drum-type tumble and hot wash machine wherein the scrap parts are first subjected to a tumbling or impacting step to remove loose residue, the scrap then being soaked in a bath of hot cleaning solution and then subjected to a spray cleaning step prior to discharge from the drum, the system including conveyor mechanism for continuously recovering scrap fines discharged from the drum as an incident of the recovery and recycling of the washing solution, together with means for continuously collecting and removing both oil and sludge from the system as the washing solution is collected for reuse.

12 Claims, 7 Drawing Figures

SCRAP WASHING SYSTEM

BACKGROUND OF THE INVENTION

The present invention relates to metal cleaning equipment and more particularly to a chemical cleaning system wherein scrap metal parts contaminated with oil, grease and other foreign materials are cleaned as an incident of being salvaged for reuse.

A conventional way of cleaning contaminated scrap metal is to incinerate the contaminants and thereafter cool the scrap material by passing it through a cooling chamber wherein it is cooled by water or air. Such incinerating procedure is subject to a number of disadvantages, including air pollution and undesirable oxidation resulting from the wide variations in temperature between burning and cooling. In addition, a substantial quantity of fuel is required to incinerate the combustibles, a typical unit capable of handling 20 tons of scrap per hour requiring 54 million btu to incinerate the contaminants.

It has also been a standard practice to clean contaminated metallic parts by passing them through a drum-type washer wherein they are selectively subjected to various chemical washing and rinsing operations, with or without subsequent drying of the parts, depending upon how and when they are to be recycled. By way of comparison, a drum-type washer capable of processing twenty tons of scrap per hour only consumes about 8,000,000 btu per hour to heat the washing solution, and at the same time does not pollute the air. Furthermore, parts cleaned by a washing operation contain less residue than parts cleaned by incineration, and where the parts are melted for reuse it has been found that washed parts produce from 20 to 25 percent less slag in the melting furnace than do parts cleaned by incineration.

There are, however, a number of disadvantages to present drum-type washers, particularly insofar as fines recovery and sludge removal is concerned. For example, a substantial amount of scrap fines are discharged from the washing drum along with the washing solution, and heretofore the washing solution has been diverted into a tank or trough extending along one side of the drum in which a series of perforated catch baskets are suspended to collect and retain the fines. In normal operation, these baskets must be removed and emptied every few hours. In addition, a portion of the removed contaminants will settle in the bottom of the trough as sludge, and must be removed by dredging at regular intervals.

In contrast to the foregoing, the present invention provides an integrated scrap washing and solution recovery system wherein both the fines and sludge, as well as free oils floating on the surface of the washing solution, are continuously and automatically removed for reuse or ready disposal.

SUMMARY OF THE INVENTION

In accordance with the present invention an elongated drum-type washer is provided through which the scrap metal parts are continuously moved and selectively subjected to one or more cleaning operations, preferably an initial impacting step in which the parts are lifted and dropped within the drum to remove loose materials, whereupon the parts are soaked in a bath of heated washing solution, and then passed to another section of the drum wherein they are subjected to a spray cleaning operation while being tumbled or agitated. The wall surface of the drum in the area of the spray cleaning operation is perforated so that the spent washing solution both from the sprays and overflow from the preceding soaking operation, flows outwardly through the perforations in the drum along with the fines and the removed contaminants. This affluent is discharged into an elongated tank extending along one side of the drum, being discharged onto the upper flight of a foraminous fines conveyor which moves toward one end of the tank and then upwardly out of the tank where the conveyor reverses direction and, in so doing, discharges the fines from the system.

The return or lower flight of the fines conveyor is directed downwardly into near contact with the bottom of the tank, the conveyor mounting spaced apart, transverse scraper bars which are positioned to come into near contact with the bottom of the tank. Accordingly, sludge formed from contaminants which have settled on the bottom of the tank, having sifted downwardly through the perforated flights of the conveyor, are dredged along the bottom of the tank by the scraper bars and deposited in a sump formed in the bottom of the tank immediately beyond the point at which the lower flight of the conveyor turns upwardly for return to the level along which the upper flight of the conveyor travels.

The sump into which the sludge is deposited has an inclined bottom which directs the sludge toward one side of the tank where it encounters a sludge conveyor having scraper bars which dredge the sludge upwardly along the bottom of an inclined chute, the sludge being discharged from the system at the top of the chute.

The washing solution flows lengthwise through the tank toward a discharge outlet at the far end of the tank, i.e., at the end opposite the fines conveyor, where the solution is pumped to settling tank for removal of residual contaminants prior to being reheated and returned to the washing drum. A gate or dam projects upwardly within the tank along the downstream side of the sludge sump to prevent the sludge from flowing toward the drain, the gate coacting with an overlying baffle to establish the solution level on the upstream side of the gate, the baffle including a skimmer acting to continuously remove oil floating on the surface of solution collected in the tank.

DESCRIPTION OF THE PREFERRED EMBODIMENT

Figure 1:
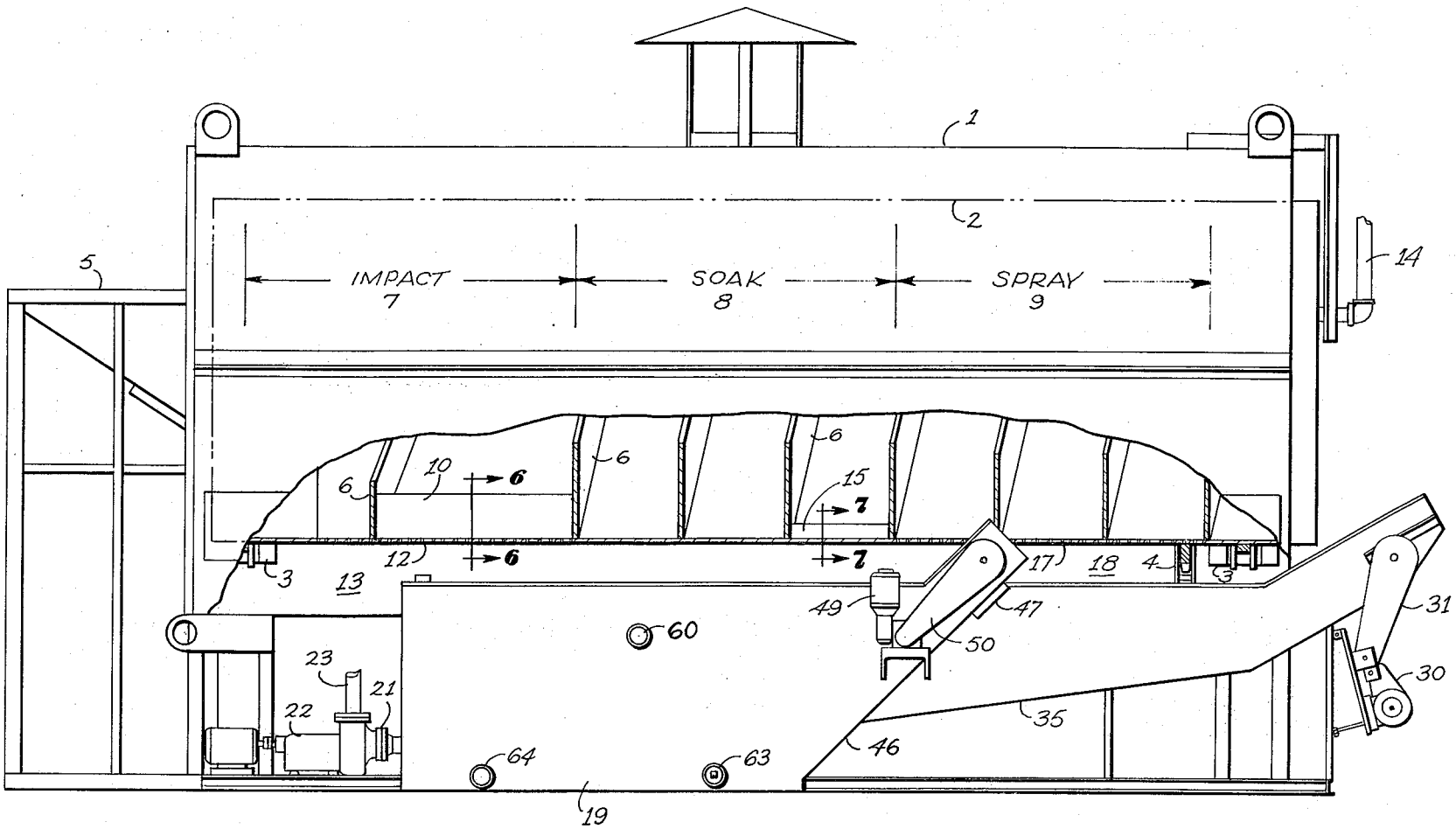
FIG. 1 is a side elevational view of a washing system in accordance with the present invention, with certain parts broken away in the interest of clarity.

Referring first to FIG. 1 of the drawings, the washing system comprises a main housing 1 mounting a horizontally disposed washing drum 2 mounted for rotation on trunnions 3, for rotation within the housing, the drum being driven by a sprocket and chain drive, indicated at 4, as will be understood by the worker in the art.

Parts to be washed are introduced into the leading end of the drum by means of a hopper 5, and it will be understood that suitable means (not shown) will be provided at the opposite end of the drum to receive the materials discharged from the drum. For example, a chute may be provided to direct the washed parts into containers for storage and transport, or onto a conveyor if the washed parts are to be transferred to a drying unit.

The parts are conveyed through the drum 2 by means of a continuous helical vane 6 extending inwardly from the cylindrical wall surface of the drum, the initial convolution of the vane commencing at the inlet end of the drum, with the final convolution terminating at the discharge end of the drum. The helical vane rotates with the drum and hence will convey the parts being cleaned from one end of the drum to the other as the drum rotates.

Figure 6:
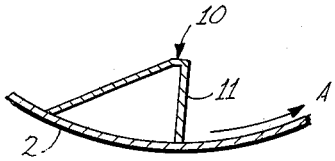
FIG. 6 is an enlarged fragmentary vertical sectional view taken along the line 6—6 of FIG. 1.

In the preferred embodiment illustrated, the drum is effectively divided into three zones — an impact zone 7, a soak zone 8, and a spray zone 9. In the impact zone 7, the parts will be lifted and dropped against the wall surface of the drum by means of kicker bars, one of which is indicated at 10 in FIG. 1, the kicker bars being mounted on the inner surface of the drum and projecting inwardly therefrom, preferably extending the full distance between adjacent convolutions of the helical vane 6. It will be understood that such kicker bars will lie at spaced apart intervals between the convolutions of the vane 6 defining the impact zone 7, and as illustrated in FIG. 6, each of the kicker bars 10 is configured to provide a lifting surface 11 extending inwardly in substantially perpendicular relation to the wall surface of the drum. With this arrangement, it will be evident that rotation of the drum in the direction of the Arrow A will cause parts engaged by the lifting surface 11 to be carried upwardly and dropped as the drum rotates. This action results in the impact cleaning of the parts to remove loose contaminants, which fall to the bottom of the drum. To facilitate removal of such loose materials, the wall surface of the drum is perforated, as indicated at 12, throughout all or a substantial portion of the impact zone, the perforations being of a size to permit loose materials to fall from the drum through the perforations 12, the perforations being sufficiently small, however to prevent the parts being cleaned from being discharged. The discharged loose materials will fall into the area 13 underlying the drum where the materials will be collected in trays or bins (not shown) for removal from the system.

Figure 7:
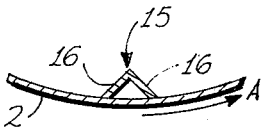
FIG. 7 is an enlarged fragmentary vertical sectional view taken along the line 7—7 of FIG. 1.

In the soak zone 8 the parts will be immersed in a bath of liquid washing solution which forms in pools between the adjacent helical convolutions in the soak zone. Washing solution will be supplied through a conduit 14 which projects inwardly through the hollow center of the drum, suitable discharge nozzles being provided in the soak zone to direct the solution downwardly between the helical vanes. The cylindrical surface of the drum is imperforate throughout the soak zone and a bath of washing solution will be maintained in the bottom of the drum having a depth substantially equal to the depth of the convolutions of the helical vane 6. If desired, agitating means in the form of agitator bars 15 may be provided to tumble the parts, the agitator bars extending between adjacent convolutions of the vane 6 in the same manner as the kicker bars 10. Preferably, however, the agitator bars 15 will be relatively shallow and of triangular shape, having inclined walls 16, as seen in FIG. 7. With this configuration, the parts will be gently tumbled as they are soaked.

As the advancing parts pass into the spray zone 9, they are sprayed with the liquid washing solution, the conduit 14 in the area of the spray zone being provided with a series of spray heads (not shown) which spray the solution downwardly onto the parts. It is preferred that the parts be gently tumbled or agitated during the spraying operation, and to this end agitator bars 15 will be provided between the adjacent convolutions in the spray zone. The drum will be perforated in the area of the spray zone, as indicated by the perforations 17, so that the used washing solution will be discharged from the drum into the area 18 underlying the spray zone, which area may comprise a collection tank. In addition to discharging washing solution sprayed onto the parts in the spray zone 9, the perforations 17 will also serve as a means for discharging excess washing solution from the soak zone 8, the excess solution flowing over the portion of the helical vane separating the two zones; and if desired, the helical vane may be somewhat reduced in depth in the area of transition from one zone to the other.

While a preference is expressed for the drum arrangement just described, it will be understood that the drum may be divided into various additional or different zones, including drain and rinse zones, depending upon the nature of the objects being cleaned and their intended after-treatment. For example where the parts are to be stored, they may be subjected to a final draining operation and then transferred to a drying chamber to remove remaining moisture.

Figure 3:
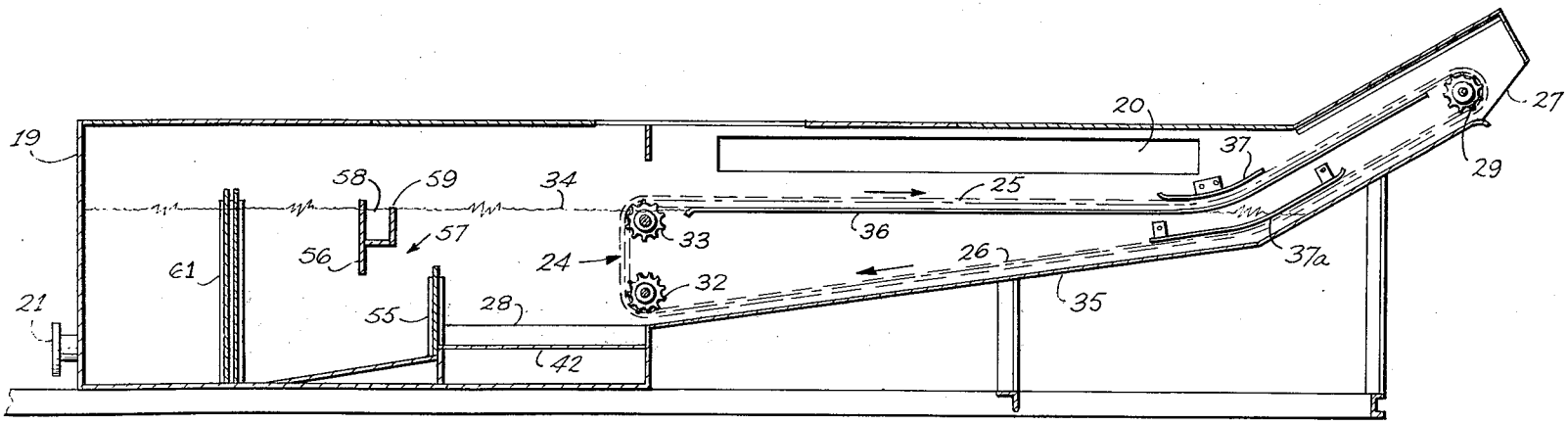
FIG. 3 is a vertical sectional view taken along the line 3—3 of FIG. 2.

In accordance with the present invention, the washing system includes an elongated recovery tank 19 extending lengthwise along one side of the drum washer into which the used washing solution discharged from the washer is collected as an incident of its reclamation for reuse. As possibly best seen in FIG. 3, the recovery tank has an elongated inlet orifice 20 positioned to communicate with the collection tank 18 underlying the spray zone 9 of the washer. A discharge outlet 21 is provided at the remote end of the tank and, as seen in FIG. 1, the outlet 21 is connected to pump means 22 by means of which solution drawn from the recovery tank may be directed through conduit 23 for further reclamation and/or reheating and recycling to the washer through conduit 14. For example, upon discharge of the solution from the recovery tank 19, it may be conveyed through the conduit 23 to a settling tank wherein residual inert contaminants in the solution will be removed, followed by reheating of the solution and, possibly, the blending of the reclaimed solution with fresh solution.

Referring again to FIG. 3, as the washing solution is introduced into the recovery tank 19 through inlet orifice 20, the solution flows over a fines conveyor 24 having an upper flight 25 and a lower flight 26, with the upper flight terminating at a discharge station 27 and the lower flight terminating at a sludge sump 28. The conveyor may be conveniently driven from sprocket means 29 at the discharge station 27, being driven by a prime mover 30, such as an electric motor, through conventional drive means 31, as seen in FIG. 1. At its opposite end, the conveyor 24 passes around idler sprockets 32 and 33 which establish the paths of the upper and lower flights, the upper flight 25 traveling beneath the inlet orifice 20 at approximately the predetermined solution level for the tank, indicated at 34. The lower flight, on the other hand, travels along the bottom of the tank which preferably comprises an inclined surface 35 extending downwardly from the discharge station 27 to the sump 28. Suitable conveyor guiding and support means are provided, such as the conveyor guide 36 and hold-downs 37 and **37*a*** which establish and maintain the desired path of travel for the fines conveyor.

Figure 4:
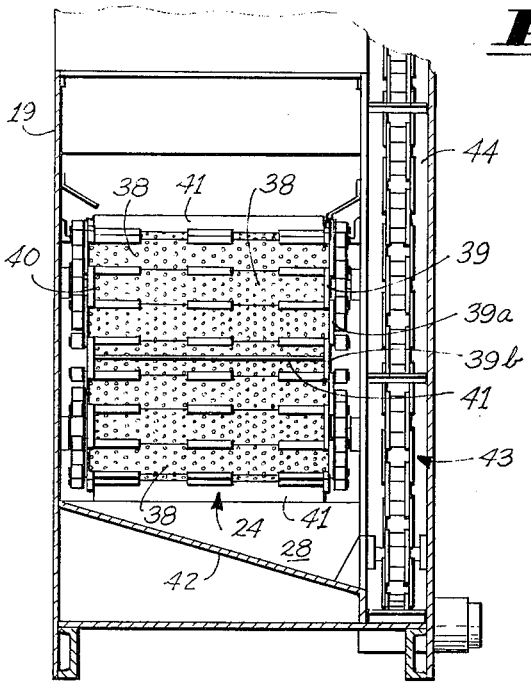
FIG. 4 is an enlarged vertical sectional view taken along the line 4—4 of FIG. 2.

As possibly best seen in FIG. 4, the fines conveyor 24 is preferably composed of a multiplicity of hingedly connected, perforated conveyor sections 38 having upstanding side wall portions 39 and 40 extending along their opposite side edges, the arrangement being such that the end edges of the end walls on adjoining conveyor sections will overlap, as will be evident by comparing the positions of end walls **39, 39*a* and 39*b*. Transverse scraper bars 41** extend between the opposite sides of the conveyor at spaced apart intervals.

With the arrangement just described, as the washing solution is introduced into the recovery tank 19, it will flow downwardly through the upper flight 25 of the fines conveyor, and the metal fines will be collected on the upper flight of the conveyor and carried to the discharge station 27 where they will be discharged for reclamation. The remaining contaminants will fall downwardly through the perforations in the upper flight and also through the perforations in the lower flight where they will collect as sludge along the bottom wall surface 35. The scraper bars 41, which are positioned to move along the bottom wall surface 35, will dredge the sludge from the wall and convey it into the sump 28 where it is collected.

Figure 5:
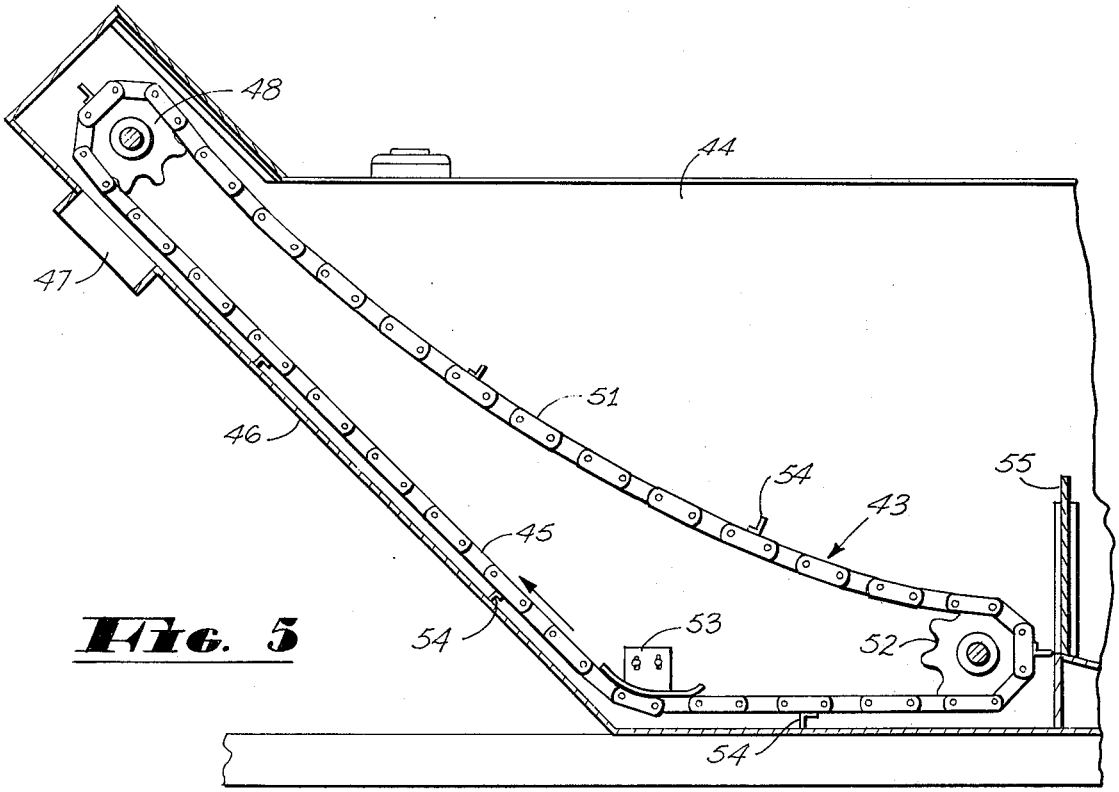
FIG. 5 is an enlarged vertical sectional view taken along the line 5—5 of FIG. 2.

As best seen in FIG. 4, the sump 28 has an inclined bottom wall 42 which directs the sludge toward the lowermost side of the sump where it lies in the path of the sludge conveyor 43 which moves within a relatively narrow compartment 44 comprising a lateral extension of the tank 19. As seen in FIG. 5, the sludge conveyor 43 has a lower flight 45 which travels upwardly along the inclined bottom wall surface 46 of the compartment 44 to a discharge station 47, which may comprise an outlet orifice positioned to discharge the sludge into an underlying container. The sludge conveyor passes around a driven sprocket means 48 which, as will be evident from FIG. 1, is operatively connected to prime mover 49 through drive means 50. The upper or return flight 51 extends downwardly from sprocket means 48 to the area of the sump where it passes around idler sprocket means 52. Suitable conveyor guide and support means, such as the hold-down means 53, is provided to maintain the lower flight of the sprocket in close proximity to the wall surface 46, as well as the lowermost extremity of the sump. The sludge conveyor is provided with spaced apart scraper bars 54 which, as will be evident from FIG. 5, dredge the sludge from the sump and carry it upwardly along the inclined wall 46 for discharge at discharge station 47.

A gate or dam 55, which is preferably removable, extends upwardly from the bottom of the recovery tank along the downstream side of the sump 28. This dam serves the dual function of maintaining the sludge in the sump, and it additionally coacts with an overlying baffle 56 to establish a controlled flow area, indicated at 57, for the solution as it flows toward the outlet end of the tank. Preferably, the baffle 56 comprises part of a skimmer trough 58 having a leading edge 59 positioned at the solution level 34 for the recovery tank. With this arrangement, oil floating on the surface of the solution will be moved toward the leading edge 59 of the skimmer as the solution flows toward discharge outlet 21, and since solution near the surface will be forced to flow downwardly as it reaches the leading edge 59 of the skimmer trough, due to the position of the controlled flow area 57, currents are created which cause the floating oil to be propelled into the skimmer trough 58. The collected oil, along with small quantities of the washing solution is removed from the trough through an outlet conduit 60 which, if desired, may be provided with pumping means.

It is also preferred to provide one or more removable screens or strainers 61 between the dam 55 and the discharge outlet 21 to prevent the discharge outlet and the associated pumping mechanism from being clogged by refuse, such as rags or other foreign objects, which might enter the system.

Figure 2:
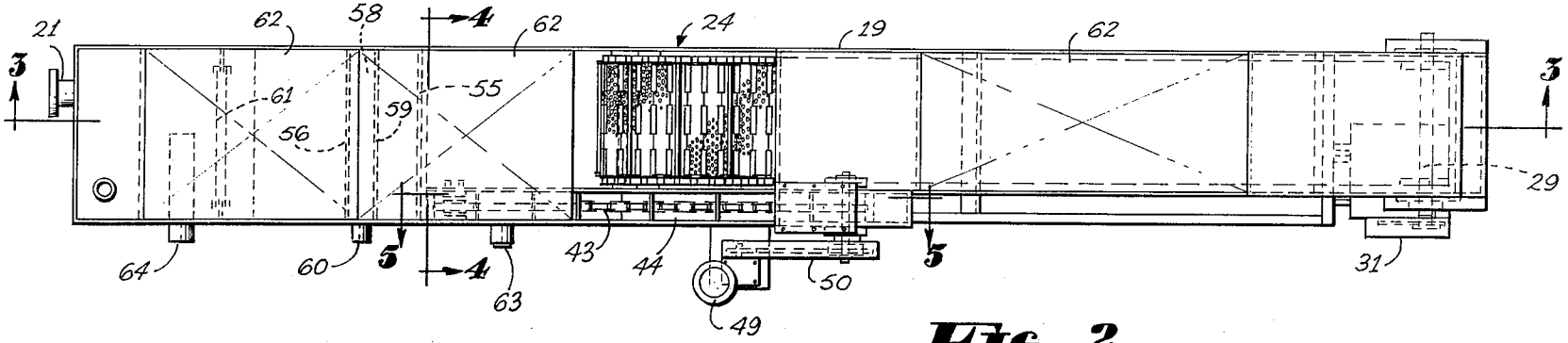
FIG. 2 is a plan view of the recovery tank and its components.

As should now be apparent, the instant invention provides an integrated liquid washing system for contaminated metal parts and the like, inclusive of means for continuously and automatically recovering metal fines and other contaminants contained in the used washing solution, thereby facilitating the recovery of the solution for reuse. Numerous modifications may be made in the invention without departing from its spirit and purpose, some of which have already been set forth and others of which will undoubtedly occur to the skilled worker in the art upon reading this specification. While particularly suited for use with a drum type washer, it should be evident that the recovery tank and its related components may be utilized in conjunction with vat or other types of liquid washers where solution recovery and contaminant removal is desired. In many instances, systems of the type contemplated by this invention are located out of doors, as in a scrap yard, and accordingly it is preferred that the recovery system be covered, and to this end it is contemplated that the recovery tank 19 will be covered by a series of removable covers, or lids, indicated at 62 in FIG. 2, one of which has been removed to expose a portion of the underlying fines conveyor. Suitable clean-out means will also be provided for the various sections of the recovery tank, as for example a clean-out plug 63 in the area of the sump 28 and the clean-out means 64 lying beyond the strainers 61.

The embodiments of the invention in which an exclusive property or privilege is claimed are defined as follows:

1. A washing system for scrap metal parts contaminated with oil, grease and the like, comprising a rotary washing drum, means within said drum for washing the scrap parts with a liquid washing solution, and means for discharging used washing solution from the drum for reclamation, the used washing solution containing metal fines and contaminants removed from the parts being cleaned, an elongated recovery tank extending along one side of the drum, said tank having a leading end and a trailing end, an elongated inlet means for introducing washing solution discharged from said drum into the upper portion of said tank adjacent the leading end thereof, outlet means at the trailing end of said tank for withdrawing washing solution therefrom, whereby the washing solution flows through said tank from the leading to the trailing end thereof, means for establishing a predetermined solution level for said tank, a fines conveyor in said tank having perforated upper and lower flights traveling beneath said inlet means, scraper means mounted on said fines conveyor, the upper flight of said fines conveyor traveling toward the leading end of said tank in close proximity to the surface of the predetermined solution level for said tank, and said lower flight traveling along the bottom of said tank in the direction of the trailing end thereof with said scraper means positioned to dredge sludge from the bottom of the tank, said fines conveyor traveling upwardly through said tank between the trailing end of said lower flight and the leading end of said upper flight, a sludge receiving sump at the end of said lower flight, and sludge removing means in communication with said sump for removing sludge therefrom.

2. The parts washing system claimed in claim 1 including a narrow compartment in communication with said sump, and wherein the means in communication with said sump for removing sludge therefrom comprises a sludge conveyor moving in said compartment between said sump and a sludge discharge station outside said tank.

3. The parts washing system claimed in claim 2 wherein said sludge conveyor has a lower flight which travels upwardly at an inclined angle through said compartment, said compartment having an inclined bottom wall underlying the lower flight of said sludge conveyor, and scraper means on said sludge conveyor positioned to dredge the sludge upwardly along said inclined bottom wall to the sludge discharge station.

4. The parts washing system claimed in claim 1 including skimming means in said tank positioned at the predetermined solution level for removing floating oil as the solution flows from said inlet means toward the outlet means at the opposite end of the tank.

5. The parts washing system as claimed in claim 4 wherein said skimming means comprises a skimming trough extending between the opposite sides of the tank, said trough having a leading edge facing toward said inlet means at about the predetermined solution level for said tank.

6. The parts washing system claimed in claim 5 wherein the means for establishing a predetermined solution level for said tank comprises a dam extending between the opposite sides of the tank and projecting upwardly from the side edge of said sump remote from said fines conveyor, and wherein said skimming trough overlies said dam in spaced relation thereto.

7. The parts washing system claimed in claim 6 including a baffle mounted on and projecting downwardly from said skimming trough, the lowermost edge of said baffle lying in spaced relation to the uppermost edge of said dam to define a controlled flow area therebetween.

8. The parts washing system claimed in claim 1 wherein said washing drum included an impact zone, a soaking zone, and a spray zone extending in the order named between the entrance and exit ends of said drum, means in said impact zone to lift and tumble the parts to remove contaminants therefrom, means in said soaking zone for soaking the parts in a bath of liquid cleaning solution, and spray means in said spray zone to spray the parts with liquid cleaning solution.

9. The parts washing system as claimed in claim 8 wherein the means for discharging the washing solution from the drum for reclamation includes perforations in the cylindrical wall surface of the drum in said spray zone and a drain tank underlying the spray zone of said drum, said drain tank being in communication with the inlet means for said recovery tank.

10. In a parts washing system wherein scrap metal parts are washed with a liquid washing solution and the used solution recovered for reuse, the used solution containing metal fines and contaminants removed from the parts being cleaned, an elongated recovery tank having a leading end and a trailing end, an elongated inlet means for introducing used washing solution into the upper portion of said tank adjacent the leading end thereof, outlet means at the trailing end of said tank for withdrawing washing solution therefrom, whereby the washing solution flows through said tank from the leading to the trailing end thereof, means for establishing a predetermined solution level for said tank, a fines conveyor in said tank having perforated upper and lower flights traveling beneath said inlet means, scraper means mounted on said fines conveyor, the upper flight of said fines conveyor traveling toward the leading end of said tank in close proximity to the surface of the predetermined solution level for said tank, and the lower flight traveling along the bottom of the tank in the direction of the trailing end thereof, with said scraper means positioned to dredge sludge from the bottom of the tank, said fines conveyor traveling upwardly through said tank between the trailing end of said lower flight and the leading end of said upper flight, a fines discharge station at the trailing end of said upper flight, a sludge receiving sump at the trailing end of said lower flight, and sludge removing means in communication with said sump for removing sludge therefrom.

11. The apparatus claimed in claim 10 wherein said fines conveyor is composed of a plurality of articulated sections having shallow side walls extending along their opposite side edges, said scraper means comprising spaced apart scraper bars extending between the opposing side walls of said articulated sections at spaced apart intervals.

12. The apparatus claimed in claim 11 including hold-down means positioned to engage and maintain the lower flight of said fines conveyor in close proximity to the bottom of the tank.

* * * * *